US010013015B2

(12) United States Patent
Ida et al.

(10) Patent No.: US 10,013,015 B2
(45) Date of Patent: Jul. 3, 2018

(54) FAST AUTO-BALANCING AC BRIDGE

(71) Applicants: Nathan Ida, Akron, OH (US); Amir Mehdi Pasdar, Solon, OH (US)

(72) Inventors: Nathan Ida, Akron, OH (US); Amir Mehdi Pasdar, Solon, OH (US)

(73) Assignee: The University of Akron, Akron, OH (US)

( * ) Notice: Subject to any disclaimer, the term of this patent is extended or adjusted under 35 U.S.C. 154(b) by 513 days.

(21) Appl. No.: 14/618,477

(22) Filed: Feb. 10, 2015

(65) Prior Publication Data

US 2015/0227159 A1 Aug. 13, 2015

Related U.S. Application Data

(60) Provisional application No. 61/937,796, filed on Feb. 10, 2014.

(51) Int. Cl.
*G05F 5/00* (2006.01)

(52) U.S. Cl.
CPC ..... *G05F 5/00* (2013.01); *Y10T 307/549* (2015.04)

(58) Field of Classification Search
CPC ..... G05F 5/00
USPC ..... 324/706, 725, 610, 648, 657, 680; 307/52
See application file for complete search history.

(56) References Cited

U.S. PATENT DOCUMENTS 2,749,510 A * 6/1956 Rively ..... G01R 31/14 315/245

6,608,492 B1 * 8/2003 Entenmann ..... G01R 17/105 324/706

OTHER PUBLICATIONS

Hans Bachmair and Reinhold Vollmert, "Comparison of Admittances by Means of a Digital Double-Sinewave Generator", IEEE Transactions on Instrumentation and Measurement, vol. IM-29, No. 4, pp. 370-372, Dec. 1980.

Wolfgang Helbach, Peter Marczinowski, and Gerhard Trenkler, "High-Precision Automatic Digital AC Bridge", IEEE Transactions on Instrumentation and Measurement, vol. IM-32, No. 1, pp. 159-162, Mar. 1983.

Mita Dutta, Anjan Rakshit, S. N. Bhattacharyya, and J. K. Choudhury, "An Application of an LMS Adaptive Algorithm for a Digital AC Bridge", IEEE Transactions on Instrumentation and Measurement, vol. IM-36, No. 4, pp. 894-897, Dec. 1987.

(Continued)

*Primary Examiner* — Joseph Chang
(74) *Attorney, Agent, or Firm* — Renner, Kenner, Grieve, Bobak, Taylor & Weber Co. LPA

(57) ABSTRACT

A system and method for fast, automatic balancing of an AC bridge utilizes a two-stage process. During the first stage, the phase of the bridge voltage is matched, while during the second stage, the amplitude is minimized. The voltage matching process is based on halving the range of measured voltage amplitudes at each step, using two samples to identify the next half-range, resulting in an n-step recursive algorithm with "n" defining the resolution of the process. As such, the phase-matching process requires only three samples per step, and only four steps for 1° resolution. Consequently, the computational power needed to carry out the two-stage process is minimal, requiring only comparison of the three sampled voltages, thereby resulting in a balancing process that is performed fast and efficiently.

1 Claim, 2 Drawing Sheets

(56) References Cited

OTHER PUBLICATIONS

Selim S. Awad, Natarajan Narasimhamurthi, and William W. Ward, "Analysis, Design, and Implementation of an AC Bridge for Impedance Measurements", IEEE Transactions on Instrumentation and Measurement, vol. 43, No. 6, pp. 894-899, Dec. 1994.
Daniel Tarach and Gerhard Trenkler, "High Accuracy N-Port Impedance Measurement by Means of Modular Digital AC Compensators", IEEE Transactions on Instrumentation and Measurement, vol. 42, No. 2, pp. 622-626, Apr. 1993.
Mita Dutta, Anjan Rakshit, and S. N. Bhattacharyya, "Development and Study of an Automatic AC Bridge for Impedance Measurement", IEEE Transactions on Instrumentation and Measurement, vol. 50, No. 5, pp. 1048-1052, Oct. 2001.
Amitava Chatterjee, Mita Dutta, and Anjan Rakshit, "An Intelligent Method of Impedance Measurement Employing PSO-Aided Neuro-Fuzzy System with LMS Algorithm", IEEE International Conference on Fuzzy Systems, Fuzz-IEEE 2007, pp. 23-28, 2007.
Jian Qiu Zhang, Seppo J. Ovaska, and Zhao Xinmin, "A Novel Fast Balance Technique for the Digital AC Bridge", IEEE Transactions on Instrumentation and Measurement, vol. 47, No. 2, pp. 371-377, Apr. 1998.
Nilangshu K. Das, T. Jayakumar, and Baldev Raj, "Noniterative Digital AC Bridge Balance", IEEE Transactions on Instrumentation and Measurement, vol. 59, No. 11, pp. 3058-3060, Nov. 2010.

* cited by examiner

FAST AUTO-BALANCING AC BRIDGE

CROSS-REFERENCE TO RELATED APPLICATION

This application claims the benefit of U.S. Provisional Application No. 61/937,796 filed on Feb. 10, 2014, the content of which is incorporated herein by reference.

TECHNICAL FIELD

Generally, the present invention relates to AC (alternating current) devices. In particular, the present invention relates to AC bridge devices. More particularly, the present invention relates to an AC bridge that is configured to be balanced in a fast, automated manner.

BACKGROUND ART

The balancing of AC (alternating current) bridges is a process that is critical in automated measurement and sensing systems, such as those used to measure/sense small changes in inductance/resistance. In addition, AC bridges of various forms have been utilized in various measurement and sensing systems, such as automatic testing systems, which are used to monitor such inductance/resistance changes.

However, such AC bridge circuits suffer from numerous technical problems. The primary problem of such bridge circuits is that of obtaining a minimum voltage and minimum phase at a middle point of the AC bridge circuit itself. In order to achieve a minimum voltage/phase at the middle point of the AC bridge, the AC bridge must be balanced, using various methods and techniques. For example, iterative methods to minimize the middle point voltage have been used. In other methods, the minimum point voltage is obtained by performing a sequence of complex computations that use a few, accurately sampled data points. With regard to the iterative method, the minimization of the middle-point voltage is achieved by computational steps performed by a computer based on a sequence of steps, which often results in the performance of many steps, which results in a slow convergence. Digital AC bridges that utilize a computer control system to carry out such iterative methods have also been developed. These digital AC bridges also provide advantages over that of conventional AC bridges, by providing measurements that have high accuracy, reproducibility, reliability, and flexibility. For example, such digital AC bridges may utilize a microprocessor that executes a least mean square (LMS) adaptive algorithm in an iterative manner to balance the bridge. However, while the LMS method is effective in balancing the AC bridge, the accuracy of the AC bridge balancing may be further improved by employing an intelligent neuro-fuzzy-based LMS module.

Iterative balancing methods, such as the LSM method, however, can be very slow as more computations are required for each step. To overcome the drawbacks of the iterative method, a non-iterative approach has also been investigated. Such non-iterative methods are desirable, as they speed-up the operation of the controller used to minimize the middle-point voltage by using Fourier coefficients of an out-of-phase voltage from the AC bridge. However, such non-iterative methods require a complicated digital signal processing (DSP) core or computational unit to carry out the complex computations and to perform the accurate data sampling that is required. As such, existing methods for balancing an AC bridge generally require highly complex computing systems, or perform balancing operations that are unacceptably slow.

Therefore, there is a need for a fast, automatic balancing AC bridge, which allows the AC bridge to measure/sense small inductance changes. In addition, there is a need for a system and method for a fast, automatic balancing AC bridge, which adds a synthetic phase offset to improve the accuracy of the phase measurement that is performed to balance the AC bridge. Furthermore, there is a need for a method for fast, automatic balancing of an AC bridge, which is based on trigonometric functions or formulas. Additionally, there is a need for a fast, automatic balancing AC bridge, whereby the balance parameters used to balance the AC bridge are analytically computed by a computer or any other suitable processing unit.

SUMMARY OF THE INVENTION

In light of the foregoing, it is a first aspect of the present invention to provide a simple, fast and accurate system and method for balancing an AC bridge for use in many applications.

It is another aspect of the present invention to provide a system and method that provide phase and voltage matching stages to match the AC bridge using a minimum number of steps.

It is yet another aspect of the present invention to provide a method of balancing an AC bridge comprising providing an AC bridge having a first AC voltage source and a second AC voltage source, wherein a predetermined impedance and an impedance to be determined are in series with the first and second AC voltage sources, such that a node defining a middle voltage is positioned between the predetermined impedance and the impedance to be determined; maintaining a voltage magnitude and a voltage phase angle of the first voltage at fixed values; adjusting a phase angle of the second voltage source, such that the middle voltage is minimized; and adjusting a magnitude of the second voltage source, such that the middle voltage is further minimized.

BRIEF DESCRIPTION OF THE DRAWINGS

These and other features and advantages of the present invention will become better understood with regard to the following description, appended claims, and accompanying drawings wherein:

DETAILED DESCRIPTION OF THE INVENTION

Figure 1:
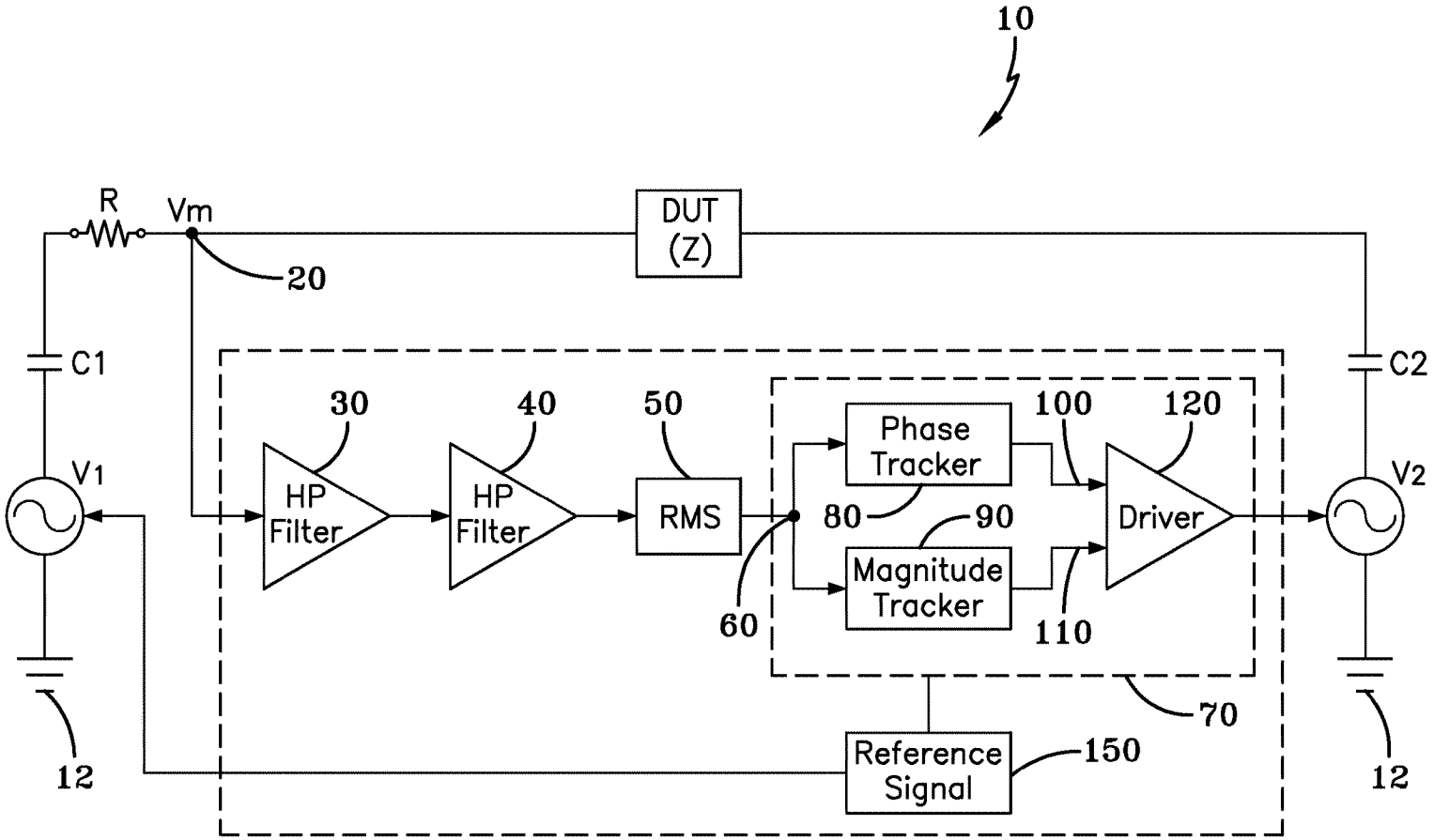
FIG. 1 is a schematic diagram of the components provided by a fast, automatic balancing AC bridge in accordance with the concepts of the present invention.

A fast, automatic balancing AC (alternating current) bridge is generally referred to by numeral 10, as shown in FIG. 1 of the drawings. It should be appreciated that the AC bridge 10 is utilized to measure or detect changes in various phenomena of a device under test (DUT), such as changes in resistance or impedance. However, it should be appreciated that for the purposes of the following discussion, the AC bridge 10 is used to analyze a device under test (DUT), which comprises an impedance Z. Specifically, the AC bridge 10 includes AC (alternating current) voltage sources, denoted as $v_1$ and $v_2$. The voltage source $v_1$ is placed in series connection with capacitor C1, resistor R, impedance Z and capacitor C2, and voltage source $v_2$. The voltage sources $v_1$ and $v_2$ are coupled to ground 12 to complete the series connection. Disposed between resistor R and impedance Z is a node 20, where voltage $V_m$ is denoted. Coupled to node 20 is a series coupled high-pass filter 30, high-pass filter 40, and an RMS (root-mean squared) component 50. Coupled in series with RMS component 50 at node 60 is a tracking component 70, which is configured to carry out the steps of a phase and voltage matching process to be discussed. The tracking component 70 is comprised of a phase tracker component 80 and a voltage magnitude tracker component 90. In one aspect, the phase tracker component 80 and the magnitude tracker 90 may be configured to operate in parallel with each other. In addition, nodes 100 and 110 provided at the output of the phase tracker component 80 and the magnitude tracker component 90, respectively, are coupled to a driver component 120. The output of the driver component 120 is coupled to the voltage source $v_2$. Coupled between the magnitude tracker component 90 and the voltage source $v_1$ is a reference signal generator 150. It should also be appreciated that the phase tracker component 80 and the magnitude tracker component 90 are coupled to the reference signal generator 150. The phase tracker component 80 and the magnitude tracker component 90 operate to minimize the voltage $V_m$ at node 20 by providing a modified reference signal that is output by the reference signal 150, which is then applied to the voltage source $v_2$. That is, the phase and magnitude of the applied signal to the voltage source $v_2$ via the reference signal generator 150 is expressed with respect to a reference signal generated by the signal generator 150. It should also be appreciated that the technique of the present invention utilizes two stages of matching to reach bridge balance condition with minimum number of steps. Moreover, it should be appreciated that the tracking component 70 and reference signal generator 150 may be implemented in computer software, computer hardware or a combination of both. It should be further appreciated that the tracking component 70 may be interfaced with the AC bridge 10 at the node 20 via the HP filters 30,40 and the RMS component 50.

Injected voltages are defined as $v_1=V_1\cos(\omega t)$ and $v_2=V_2\cos(\omega t+\theta)$, with the phase angle difference between the two voltages being defined by θ. As such, the magnitude of $V_1$ is kept constant by the signal output by the reference signal generator 150, while the magnitude of $V_2$ and the phase angle θ are adjusted independently to obtain a minimum voltage at the middle point ($V_m$) of the AC bridge 10. Based on the phase difference and the combination of the two voltages $V_1$ and $V_2$, the voltage at the middle point $V_m$ of the AC bridge 10 in the phase domain is defined as:

$$V_m = \frac{V_2 R}{R+Z} + \frac{V_1 Z}{R+Z}, \tag{1}$$

where the unknown impedance to be identified of the DUT is defined as:

$$Z=Z_a+jZ_b \tag{2}$$

By substituting equation (2) into equation (1) the middle point voltage is now defined as:

$$V_m = \frac{V_2 R}{R+Z} + \frac{V_1}{R+Z}(\cos\theta + j\sin\theta)(Z_a + jZ_b).$$

Thus, the middle point voltage may be expressed as:

$$V_m=f(R,Z)V' \tag{3}$$

where f(R,Z) is a complex function of the impedance Z of the device under test (DUT) and the fixed resistor R; while V' is a function of the voltage sources ($V_1$ and $V_2$), as well as the bridge impedances. The magnitude of V' is:

$$|V'| = \sqrt{V_2^2R^2 + V_1^2|Z|^2 + 2V_1V_2R(Z_a\cos\theta + Z_b\cos\theta + Z_b\sin\theta)}\ . \tag{4}$$

Because the other bridge impedances are constant, it is sufficient to minimize V'.

Control Algorithm

Figure 2:
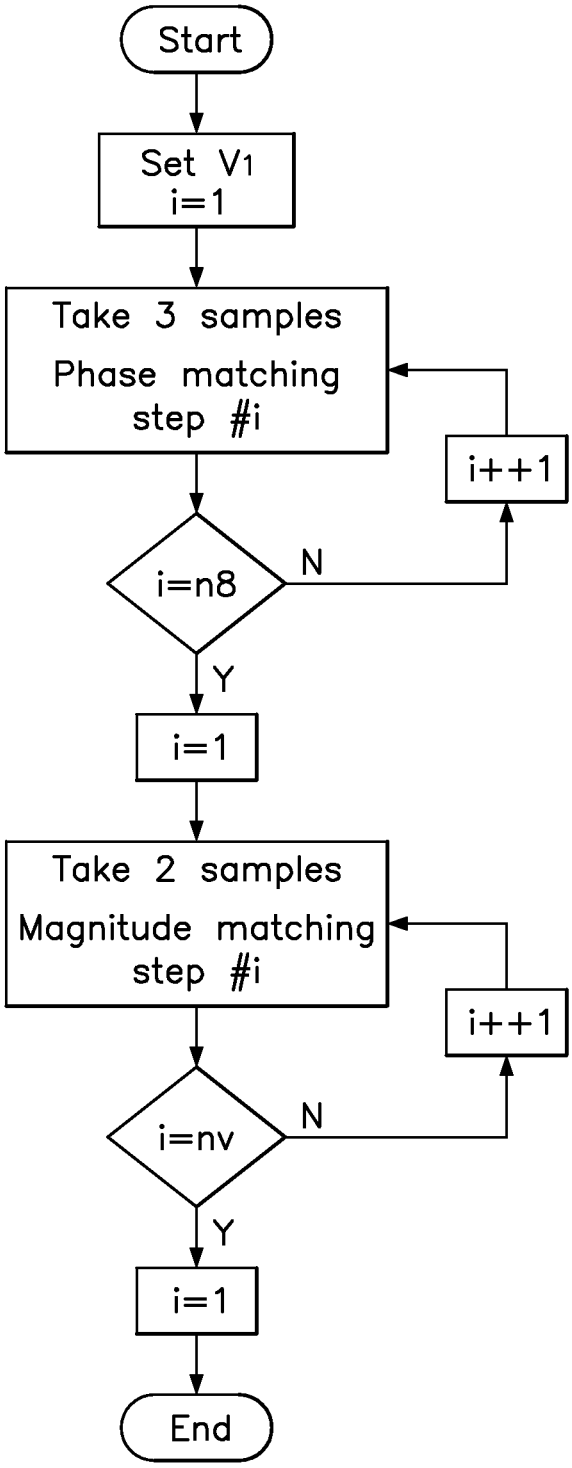
FIG. 2 is a block diagram of a magnitude and phase-matching process utilized by the AC bridge of FIG. 1 for fast, automatic balancing of the AC bridge in accordance with the concepts of the present invention.

The process for minimizing the voltage $V_m$ at the middle point of the AC bridge 10 that is carried out by the tracking component 70 is performed by setting the voltage $V_1$ to a fixed amplitude/magnitude with zero phase angle, and adjusting the amplitude/magnitude of $V_2$ and adjusting its associated phase angle θ using a minimization process to be discussed. Specifically, the minimization process is performed in two sequential stages or steps, whereby a phase angle matching process is performed and then a voltage minimization process is performed. As such, the first stage matches the phase angle of $v_2$ to minimize the voltage in equation (4). The second stage minimizes the magnitude of V' by setting the magnitude $V_2$ of $v_2$. The following discussion presents the phase-matching process, which is then followed by a discussion of the voltage minimization process, as shown in FIG. 2. It should be appreciated that the minimization process carried out by the tracking component 70 may be embodied in hardware, software or a combination of both, and executed using any suitable computing system.

A. Phase Matching

During the phase angle matching stage, the voltage $V_m$ is minimized with a minimum number of samples and steps. The purpose of the minimization process is to find the phase angle θ that will minimize V'. During this part of the process, the amplitude/magnitude of $v_2$ is kept constant. V' may be simplified into a much simpler form as:

$$|V'(\theta)|=\sqrt{a+b\cos\theta+c\sin\theta} \tag{5}$$

where a, b and c are constants that are defined based on voltages $V_1$ and $V_2$. The three voltage samples are taken at three equally-spaced phase angles (although other phase angle spacing may be used) for each step, which are defined as:

$$\begin{aligned} V'(1, i) &= V'(\theta_i) \\ V'(2, i) &= V'\left(\theta_i + \frac{\text{band}_i}{2}\right) \\ V'(3, i) &= V'(\theta_i + \text{band}_i), \end{aligned} \tag{6}$$

where $\theta_i$ is the base phase for the $i^{th}$ step and $\text{band}_i$ is the phase angle searching band or range for the $i^{th}$ step.

In the first step, the range (i.e. band) between 0° and 360° needs to be considered for the search. The voltage measurement is sampled at 0°, 120° and 240°. The three voltage samples are compared and depending on the relation between them, a mode is defined. There are six possible modes that are defined based on three voltage measurements, as shown in Table I. The condition associated with each mode narrows the phase angle searching band or range to 60°.

TABLE I

| Definition of Modes in the First Step: | |
|---|---|
| Mode | Sample Relation |
| 1 | V'(3, 1) > V'(2, 1) > V'(1, 1) |
| 2 | V'(3, 1) > V'(1, 1) > V'(2, 1) |
| 3 | V'(2, 1) > V'(3, 1) > V'(1, 1) |
| 4 | V'(2, 1) > V'(1, 1) > V'(3, 1) |
| 5 | V'(1, 1) > V'(3, 1) > V'(2, 1) |
| 6 | V'(1, 1) > V'(2, 1) > V'(3, 1) |

Table II below lists the 6 modes and their corresponding phase angle shift ($shift_i$) that is required at each step, which is denoted by "i". This phase shift defines the lower limit of the phase angle that will minimize the middle point voltage. The upper limit is $shift_i$ plus the span of a mode. The new effect of the first step is to narrow the search to a 60° range between $shift_i$ and $shift_i$+60°.

TABLE II

| Definition of Phase Shift for each Step: | | | | | | |
|---|---|---|---|---|---|---|
| Mode | 6 | 5 | 2 | 1 | 3 | 4 |
| $shift_i$ | $3seg_i$ | $2seg_i$ | $3seg_i$ | $seg_i$ | $-seg_i$ | $-2seg_i$ |

The base phase for the second step is defined based on the first step base phase and the corresponding phase shift due to the first three samples mode. The $i^{th}$ step base phase for i>1 is defined as:

$$\theta_i=\theta_{i-1}+shift_{i-1} \tag{7}$$

In the first step, $\theta_1=0$ and $band_1=240°$. In each subsequent step i>1 three samples are taken within the range, whereby, one is taken at the starting base phase $\theta_i$; a second is taken in the middle of the range ($\theta_i+band_i/2$); and a third is taken at the end point of the range ($\theta_i+band_i$). The three sampled voltages V'(1, i), V'(2, i) and V'(3, i) are compared with the one in the previous step. However, in other embodiments more or fewer sampled voltages may be compared. There are four possible relations between the three voltage measurements, as shown in Table III. For steps >1, $band_i$ and $seg_i$ are defined based on the following recursive formulas:

$$band_i = seg_{i-1} \tag{8}$$

$$seg_i = \frac{band_i}{4}, \tag{9}$$

where $seg_i$ is the phase angle range, which is defined with respect to the related modes in the $i^{th}$ step; in the first step $seg_i$=60°.

TABLE III

| Definition of Modes in the step >1: | |
|---|---|
| Mode | Sample Relation |
| 1 | V'(3, 1) > V'(2, 1) > V'(1, 1) |
| 2 | V'(3, 1) > V'(1, 1) > V'(2, 1) |

TABLE III-continued

| Definition of Modes in the step >1: | |
|---|---|
| Mode | Sample Relation |
| 5 | V'(1, 1) > V'(3, 1) > V'(2, 1) |
| 6 | V'(1, 1) > V'(2, 1) > V'(3, 1) |

Based on the method discussed, the phase-matching error after $\eta_\theta$ phase-matching steps is:

$$\text{Phase error} = \frac{60°}{4^{\eta_\theta-1}}. \tag{10}$$

The number of the required samples to perform the $\eta_\theta$ steps is $3\eta_\theta$.

B. Magnitude Matching

At the end of the phase-matching stage or step, the amplitude of the middle node voltage $V_m$ is the minimum possible value achieved during the phase-matching procedure. The phase of the $v_2$ signal at this stage is $\theta_{min}$, which satisfies the minimum value of equation (5). $\theta_{min}$ is provided as:

$$\theta_{min} = \tan^{-1}\left(\frac{Z_b}{Z_a}\right). \tag{11}$$

By substituting equation (11) into equation (4), |v'| at the end of the phase-matching procedure is:

$$|V'(\theta_{min})| = \sqrt{V_2^2R^2 + V_1^2|Z|^2 + 2V_1V_2R\left(Z_a\cos\left(\tan^{-1}\frac{Z_b}{Z_a}\right)\right) + Z_b\sin\left(\tan^{-1}\frac{Z_b}{Z_a}\right)}. \tag{12}$$

In addition, equation (12) can be simplified as:

$$|V'|=|V_2R+V_1|Z|| \tag{13}$$

There will be two samples for each step, which are defined in the following:

$$\begin{cases} V'(1, i) = V'(V_{min}(i)) \\ V'(2, i) = V'(V_{max}(i)) \end{cases}, \tag{14}$$

where $V_{min}(i)$ and $V_{max}(i)$ are the minimum and maximum voltages of the $V_2$ for the $i^{th}$ step. For the first step, the minimum and maximum voltage is defined as:

$$\begin{cases} V_{min}(1) = Vd_{min} \\ V_{max}(2) = Vd_{max} \end{cases}, \tag{15}$$

where $Vd_{min}$ and $Vd_{max}$ are the minimum and maximum achievable voltage the hardware can produce for $v_2$.

There are three different trends of high frequency voltage samples that are based on the relationship between them. The following three different scenarios occur in each step:

$$\begin{cases} V_{min}(i) < V_2 < \frac{V_{max}(i)}{2}: \text{ if } V'(V_{min}(i)) < V'(V_{max}(i)) \\ V_2 = \frac{V_{min}(i) + V_{max}(i)}{2}: \text{ if } V'(V_{min}(i)) = V'(V_{max}(i)) \\ \frac{V_{max}(i)}{2} < V_2 < V_{max}(i): \text{ if } V'(V_{min}(i)) > V'(V_{max}(i)) \end{cases} \quad (16)$$

The magnitude matching steps start by obtaining two samples indicated as $V'(V_{min}(1))$ and $V'(V_{max}(1))$. The whole range of possible voltages is divided into two regions. Comparison of the magnitudes of the two samples indicates the region where the minimum amplitude occurs. In the next step, the specified region will be divided into two separate regions. In each step, the size of the regions that contains the minimum point becomes smaller. The sampling range for steps >1 is defined as follows:

$$\begin{cases} \left\{ \begin{matrix} V_{min}(i) = V_{min}(i-1) \\ V_{max}(i) = \frac{V_{min}(i-1) + V_{max}(i-1)}{2} \end{matrix} \right\}: \text{ if } V'(V_{min}(i)) < V'(V_{max}(i)) \\ \left\{ \begin{matrix} V_{min}(i) = V_{min}(i-1) \\ V_{max}(i) = V_{max}(i-1) \end{matrix} \right\}: \text{ if } V'(V_{min}(i)) = V'(V_{max}(i)) \\ \left\{ \begin{matrix} V_{min}(i) = \frac{V_{min}(i-1) + V_{max}(i-1)}{2} \\ V_{max}(i) = V_{max}(i-1) \end{matrix} \right\}: \text{ if } V'(V_{min}(i)) > V'(V_{max}(i)) \end{cases} \quad (17)$$

The magnitude matching error due to $\eta_v$ steps of magnitude matching procedure is defined as:

$$\text{Magnitude error} = \frac{Vd_{max}}{2^{\eta_v}}. \quad (18)$$

At the end of the magnitude matching process, the magnitude of V' will be the minimum achievable voltage magnitude based on the number of matching steps. The search algorithm is summarized in FIG. 2.

C. Signal Matching Error

The magnitude and phase of $v_2$ is set in several steps to minimize the amplitude of the voltage at the middle point of the network. By substituting the relative magnitude and phase errors in equation (4), the maximum error presented on the middle point can be expressed as:

$$|V_m|_{err} = \sqrt{\frac{\left(\frac{V_1|Z|}{R} \pm \frac{Vd_{max}}{2^{\eta_v}}\right)^2 R^2 + V_1^2|Z|^2 + 2V_1R\left(\frac{V_1|Z|}{R} \pm \frac{Vd_{max}}{2^{\eta_v}}\right)f(\eta_\theta)}{|R+Z|}}$$

where $\eta_v$ is the number of magnitude matching procedure and $\eta_\theta$ is the number of phase-matching procedure. $f(\eta_\theta)$ is expressed as:

$$f(\eta_\theta) = Z_a\cos\left(\tan^{-1}\left(\frac{Z_b}{Z_a}\right) + \frac{60°}{4^{\eta_\theta - 1}}\right) + Z_b\sin\left(\tan^{-1}\left(\frac{Z_b}{Z_a}\right) + \frac{60°}{4^{\eta_\theta - 1}}\right). \quad (19)$$

The objective of the phase and magnitude matching procedure is to minimize the magnitude of $V_m$. The resultant magnitude of the voltage at the end of the phase and magnitude matching procedure is dependent on the number of the steps of the matching process, network impedance, as well as the upper band of the voltage, which hardware can produce at $v_2$.

The performance of the bridge balancing method for a device under test (DUT) is evaluated, where $V_1$=1V, R=100 Ohms, DUT=100 Ohms+10 nF and the frequency of operation is 100 kHz. The performance of the phase and magnitude matching method are first simulated. The matching speed and accuracy is then compared with general LMS method. In the second step, the bridge is set ups in the laboratory and the phase and magnitude of the voltage sources are controlled with a programmed algorithm in Labview. The Labview in 15 steps searches for phase and magnitude of $v_2$ in order to decrease the amplitude of the middle node voltage. The impedance of the device under test (DUT) at the frequency of operation is: Z=100−j159.15 (20).

Simulation to Find the Proper Phase

In order to find the proper phase of $v_2$, 8 steps ($\eta_\theta$) are performed in the phase-matching procedure; similarly 8 steps ($\eta_v$) in magnitude matching procedure are accomplished to find the proper magnitude of $v_2$. At the end of each step, the difference between the upper and lower phase searching bands are decreased. As presented, after 5 steps the accuracy of the phase-matching procedure is better than 1°.

At the end of each step, the difference between the upper and the lower magnitude searching band is decreased. After 8 steps, the accuracy of the magnitude matching procedure is better than 10 mV. The magnitude and phase of $v_2$ at the end of the phase and magnitude matching procedure are found to be 1.07 V and 237.9°.

With regard to performance, in the method of the present invention, the total number of phase matching and magnitude matching is 16. For the general LMS matching method, the total number of the matching procedure is selected to be 16. Based on the presented results, the method of present invention has less perturbation as compared to the general LMS matching method; moreover the magnitude of V' at the end of the matching method is 0.068 V, while this magnitude for the general LMS matching method is 0.959 V, which shows better matching accuracy for the method of the present invention with the same number of matching steps.

Therefore, the method of the present invention is based on simple step-by-step algorithms for minimization of voltage based on a phase-matching process that is followed by an n-step division process for the minimization of amplitude. In each step in the phase minimization process, samples of the phase are taken at three points (although more or fewer may be used), and estimates of the range in which the minimum phase resides are determined, thus narrowing the range in each step. Four steps are sufficient for an accuracy of one degree, but higher accuracy is possible with the performance of additional estimation steps (however, fewer steps may also be used). The implementation of the method of the present invention is simple since the only computation required is the comparison of three samples (although any other number of samples may be used). Minimization of the amplitude is performed by division of the possible voltage range into two sub-ranges, and identification of the half-range in which the minimization resides as input to the next step.

Based on the foregoing, the advantages of the present invention are readily apparent. The main advantage of this invention is to provide a method for automatic AC bridge balancing that is fast and efficient. Still another advantage of the present invention is to provide a fast, automatically balancing AC bridge that uses phase and voltage matching techniques, which requires a low computational load. Yet another advantage of the present invention is to provide a fast, automatically balancing AC bridge that can be balanced more efficiently than that using general LMS balancing methods.

Thus, it can be seen that the objects of the present invention have been satisfied by the structure and its method for use presented above. While in accordance with the Patent Statutes, only the best mode and preferred embodiment has been presented and described in detail, it is to be understood that the present invention is not limited thereto or thereby. Accordingly, for an appreciation of the true scope and breadth of the invention, reference should be made to the following claims.

What is claimed is:

1. A method of balancing an AC bridge comprising:

providing an AC bridge having a first AC voltage source and a second AC voltage source, wherein a predetermined impedance and an impedance to be determined are in series with said first and second AC voltage sources, such that a node defining a middle voltage is positioned between said predetermined impedance and said impedance to be determined;

maintaining a voltage magnitude and a voltage phase angle of said first voltage at fixed values;

adjusting a phase angle of said second voltage source, such that said middle voltage is minimized; and adjusting a magnitude of said second voltage source, such that said middle voltage is further minimized, wherein said adjusting of said magnitude of said second voltage source further comprises:

dividing a predetermined range of said magnitudes of said second voltage source into at least two sub-ranges;

performing a plurality of samples of said middle voltage when said second voltage source is at a maximum magnitude and at a minimum magnitude;

identifying a sub-range in which said minimum magnitude of said middle voltage occurs;

dividing said identified sub-range into two or more sub-sub ranges;

performing a plurality of samples of said middle voltage when said second voltage source is at each of two magnitudes within each sub-sub range; and identifying a minimized magnitude for said second voltage source, which minimizes said middle voltage.

* * * * *